US005446474A

United States Patent [19]

Wade et al.

[11] Patent Number: 5,446,474

[45] Date of Patent: Aug. 29, 1995

[54] REDEPLOYABLE FURLABLE RIB REFLECTOR

[75] Inventors: William D. Wade, Los Gatos; Matthew P. Casebolt, Fremont, both of Calif.

[73] Assignee: Lockheed Missiles & Space Company, Inc., Sunnyvale, Calif.

[21] Appl. No.: 184,243

[22] Filed: Jan. 19, 1994

[51] Int. Cl.[6] ..... H01Q 15/20

[52] U.S. Cl. ..... 343/915; 343/912

[58] Field of Search ..... 343/781 P, 915, 912, 343/916, 840; H01Q 15/20; 435/29, 30, 33.2

[56] References Cited

U.S. PATENT DOCUMENTS

| | | | |
|---|---|---|---|
| 3,217,328 | 11/1965 | Miller | 343/840 |
| 3,235,872 | 2/1966 | Schepts | 343/982 |
| 3,541,569 | 11/1970 | Berks et al. | 343/915 |
| 4,030,103 | 6/1977 | Campbell | 343/915 |
| 4,115,784 | 9/1978 | Schwerdtfeger | 343/915 |
| 4,608,571 | 8/1986 | Luly | 343/781 |
| 4,647,943 | 3/1987 | Metcalfe | 343/916 |
| 4,683,475 | 7/1987 | Luly | 343/915 |
| 4,811,033 | 3/1989 | Ahl et al. | 343/880 |
| 4,899,167 | 2/1990 | Westphal | 343/915 |
| 5,198,832 | 3/1993 | Higgins et al. | 343/915 |

FOREIGN PATENT DOCUMENTS

| | | | |
|---|---|---|---|
| 0296602 | 12/1987 | Japan | H01Q 15/200 |

*Primary Examiner*—Donald Hajec

*Assistant Examiner*—Tho Phan

*Attorney, Agent, or Firm*—Feix & Feix; John J. Morrissey; H. Donald Volk

[57] ABSTRACT

A redeployable, furlable rib reflector which is furlable and unfurlable between a first stowed position and a second deployed position. The reflector includes a hub assembly having spaced apart top and bottom plate members adapted to receive an antenna feed assembly mounted thereon and a plurality of attachable modular rib assemblies spaced about a periphery thereof. Each modular rib assembly includes a rib member for supporting a metalized mesh reflector surface attached thereto, a channel section base member, and a hinge assembly for pivotally connecting the rib members to their respective channel section base members. The channel section base members, in turn, are attachable between the top and bottom plate members of the hub assembly and also form a portion of the peripheral wall of the hub assembly. The invention further includes a manually actuable rib furling apparatus which includes an annular ring assembly rotatably mounted to the hub and a plurality of rib furling elements extended therefrom and interposed between selected adjacent pairs of rib members. The annular ring assembly also includes handles to facilitate rotation of the annular ring assembly in order to bring the rib furling elements into contact with the ribs for furling or unfurling about the hub.

19 Claims, 8 Drawing Sheets

REDEPLOYABLE FURLABLE RIB REFLECTOR

BACKGROUND OF THE INVENTION

The present invention relates generally to redeployable dish reflectors and, more particularly, to low cost furlable rib parabolic dish reflectors for use with radio frequency antenna assemblies. Redeployable reflectors of the kind described herein are advantageously used in conjunction with mobile and portable ground station communication applications.

Reflectors for use in conjunction with radio frequency antenna assemblies for ground station communication applications are well know in the art. In accordance with typical prior art designs, such reflectors consist of a parabolic dish-shaped reflector surface that is stretched across and attached to a plurality of ribs which are individually pivotally connected to and radially extended from a central support hub.

Heretofore, however, most known prior art reflectors are prohibitively expensive to fabricate and maintain in good repair when adapted for use in mobile or portable ground station communication applications. For such applications, it is desirable that the reflector be deployable and stowable for transport to a different site where it can then be conveniently redeployed. It is further desirable that the reflector be manually stowable and redeployable in a rapid manner by only a single person.

Further still, it is desirable that the redeployable reflector be constructed from commercially available components in a very simple and low cost manner thereby avoiding the need for expensive specially fabricated and high precision parts of the prior art, such as, for example, precision spherical bearings and pivot assemblies used for pivotally attaching the ribs to the central support hub.

It is further desirable that the overall design, installation and break down of the reflector be simple such that fabrication and adjustment can be carried out using only common hand tools and basic machine tools. It would be of further advantage where only low or minimally skilled labor is needed for deployment and redeployment of the reflector.

Finally, it is desirable that the design for the reflector permit construction of dish diameter sized for a particular application such that any greater of fewer number of supporting radial ribs can be added to or removed from the central hub in order to fine tune the accuracy of the reflector surface configuration for good performance within a particular range or band width of signal frequencies.

SUMMARY OF THE INVENTION

List of Objectives

Methods and apparatus which incorporate the desired features described above and which are effective to function as described above constitute specific objects of this invention.

It is a particular objective of the present invention to provide a low cost furlable rib reflector of simple construction which makes use of readily available components and is capable of adjustment using simple tools.

It is another object of the invention to provide ribs which are modular in design and are capable of selective attachment to a central hub in order to permit adaption to virtually any size reflector and/or fine tuning of the accuracy of the reflector surface.

Briefly, a preferred embodiment of the present invention is directed to a redeployable, furlable rib reflector which is furlable and unfurlable between a first stowed position and a second deployed position. The reflector comprises a generally spool-shaped hub assembly adapted to receive an antenna feed horn assembly mounted thereon and which includes a top plate member and a bottom plate member spaced therefrom. A plurality of modular rib assemblies are provided, spaced about the periphery of the hub assembly. Each modular rib assembly includes a channel section base member attachable between the top and bottom plate members and a generally, upwardly (parabolically shaped) curved rib member. The rib members are constructed of a suitably stiff material such that when the reflector is in the deployed position, the rib members support a preformed lightweight flexible metalized mesh material stretched there across and attached thereto to form a dish-shaped reflective surface. At the same time, the rib members are elastic or furlable upon application of a bending force to permit circumferential wrapping or furling about the hub periphery during stowage operation.

The modular rib assemblies further include simple a door hinge for pivotally attaching the inward end of each rib member to its respective channel section base member. The hinge axis of each hinge is preferably obliquely oriented with respect to the vertical axis of the adjoining channel section base member to facilitate compact stowage of the reflector, i.e., the parabolically curved upward ribs are angled slightly upward at their inner hub ends in order to achieve a lower stack height when furled about the hub.

The invention further includes manually actuable rib furling means comprising an annular ring assembly which is rotatably attached to the hub for furling and unfurling the rib members about the hub between the stowed and deployed positions of the reflector. The annular ring assembly is provided with a number of rib furling elements in the form of candle-like members which extend therefrom and which are interposed between selected adjacent pairs of ribs. The annular ring assembly also includes a handle, and preferably two opposed handles, disposed along its circumference which can be manually actuated by a user for rotating the annular ring assembly in order to bring the rib furling elements into contact with the ribs.

A simple bearing keeper assembly is also provided for rotatably mounting the annular ring assembly to the hub. In the preferred embodiment the bearing keeper includes a plurality of hard plastic button-like spacers affixed to the bearing side of the annular ring assembly for riding on top of the adjacent mating surface of the hub (i.e., the bottom plate member of the hub) and a plurality of button-like retainers fixed to and extended from the annular ring assembly and positioned to engagingly retain the peripheral edge of the bottom plate member of the hub. In an alternate embodiment, a single TEFLON® (TEFLON is a registered trademark of DuPont Corporation) ring bearing like material or coating is providing in place of the hard plastic button-like spacers.

List of Advantages

An important advantage of the present invention is that the channel section base member of each modular rib assembly forms a peripheral wall portion of the hub, thereby simplifying the hub design and serving a dual function of: (1) stiffening the hub; and (2) providing a point of attachment for the rib members to the hub.

Another advantage of the present invention is that all components for the reflector are either readily commercially available or can be easily fabricated using basic machine tools.

Still another advantage of the present invention is that the reflector can be assembled and adjusted using only simple hand tools. For example, since the pivotal attachment of the rib members to the hub make use simple commercially available door hinges, accurization or adjustment of the pivot assembly may be carried out using only a ball peen hammer.

These and other objects and advantages of the present invention will no doubt become apparent to those skilled in the art from the following drawings, detailed description of the preferred embodiment and the appended claims.

BRIEF DESCRIPTION OF THE DRAWINGS

The invention will be better understood by reference to the following detailed written description and to the drawings in which:

FIG. 6A also illustrates one embodiment for the bearing keeper assembly which includes a plurality of hard plastic button spacers spaced apart along the circumference of the annular ring assembly for providing a slidable bearing surface between the annular ring assembly and the bottom plate member of the hub assembly.

DESCRIPTION OF THE PREFERRED EMBODIMENT

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
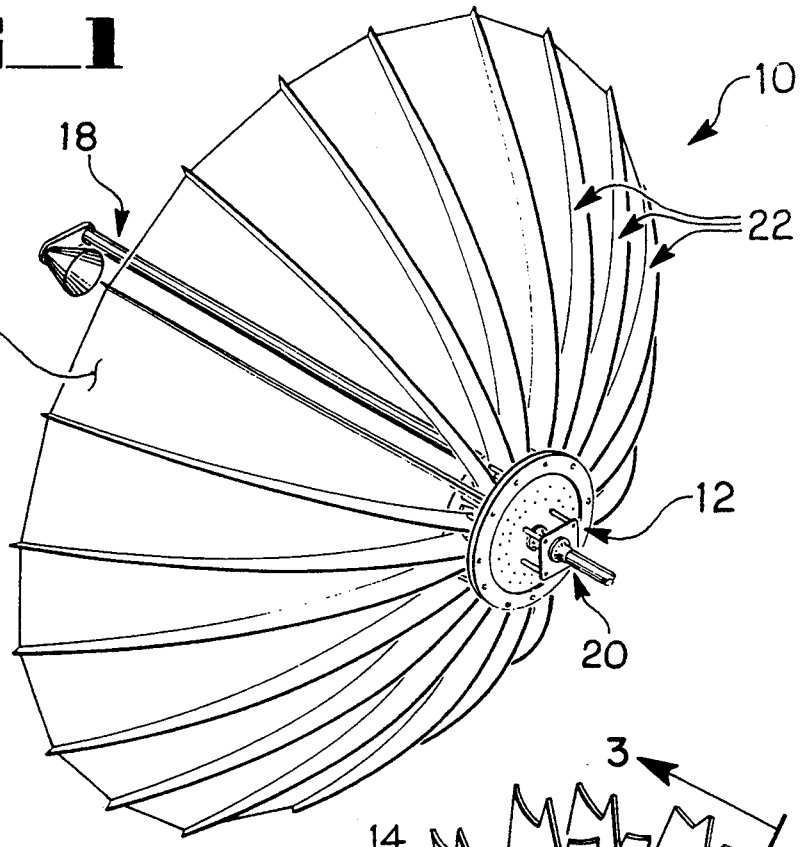
FIG. 1 is a perspective view of one embodiment of the redeployable furlable rib reflector shown in the deployed position.

A redeployable furlable rib reflector constructed in accordance with one embodiment of the present invention is indicated generally by reference numeral 10 in FIG. 1.

The reflector 10 in FIG. 1 is shown in the deployed position and includes a central hub assembly 12 on which an antenna feed assembly 18 is mounted and which, in turn, is mountable to a fixed support (not shown) by a standoff assembly 20. The reflector 10 further includes a plurality of radially extendable modular rib assemblies 22 spaced about and pivotally attached to the hub assembly 12. In the deployed position shown, the modular rib assemblies form a parabolic dish shape. A light weight metalized mesh 24 is stretched across and secured to the modular rib assemblies 22 to form the dish-shaped reflective surface.

Figure 2:
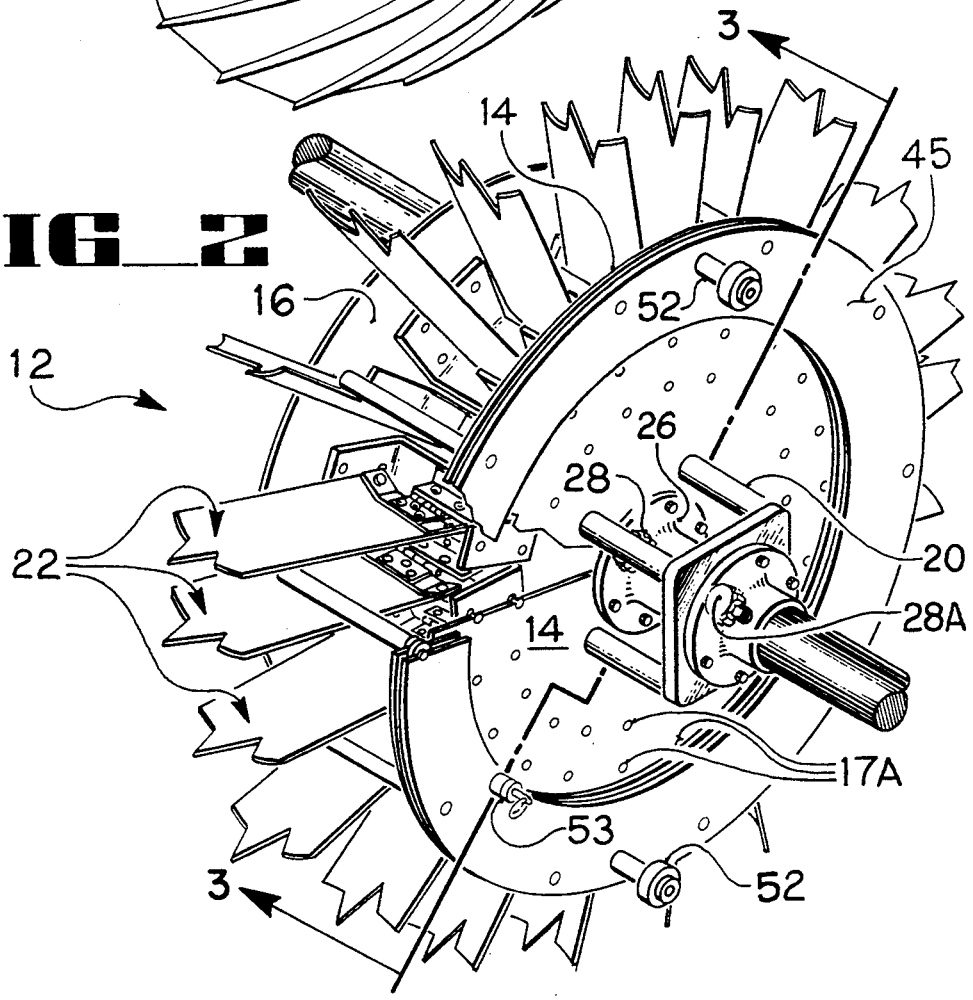
FIG. 2 is an enlarged fragmentary perspective view of the central hub assembly region of FIG. 1.
Figure 3:
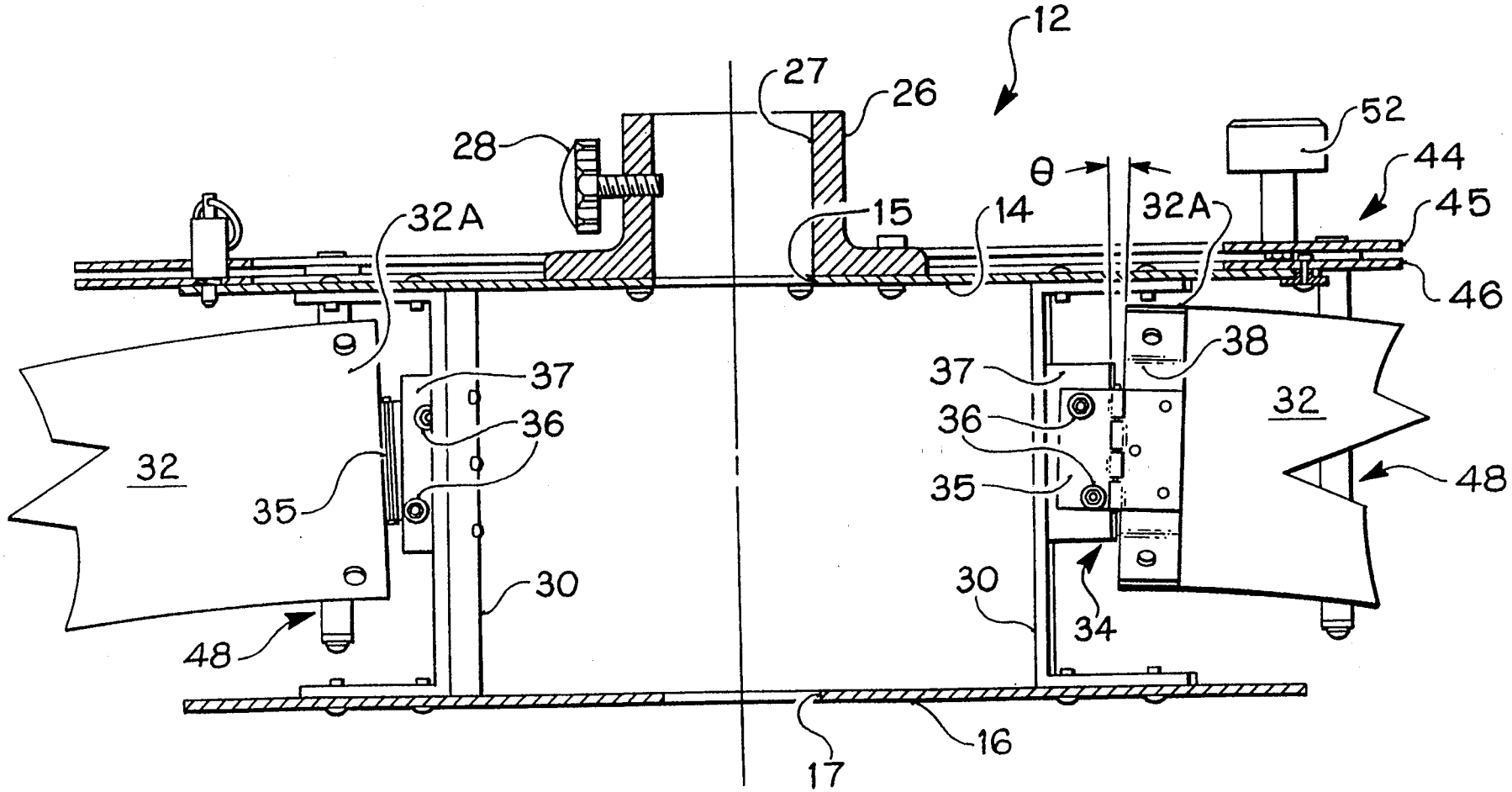
FIG. 3 is a side elevation view in cross section taken along the line and in the direction of arrows 3—3 of FIG. 2.
Figure 4:
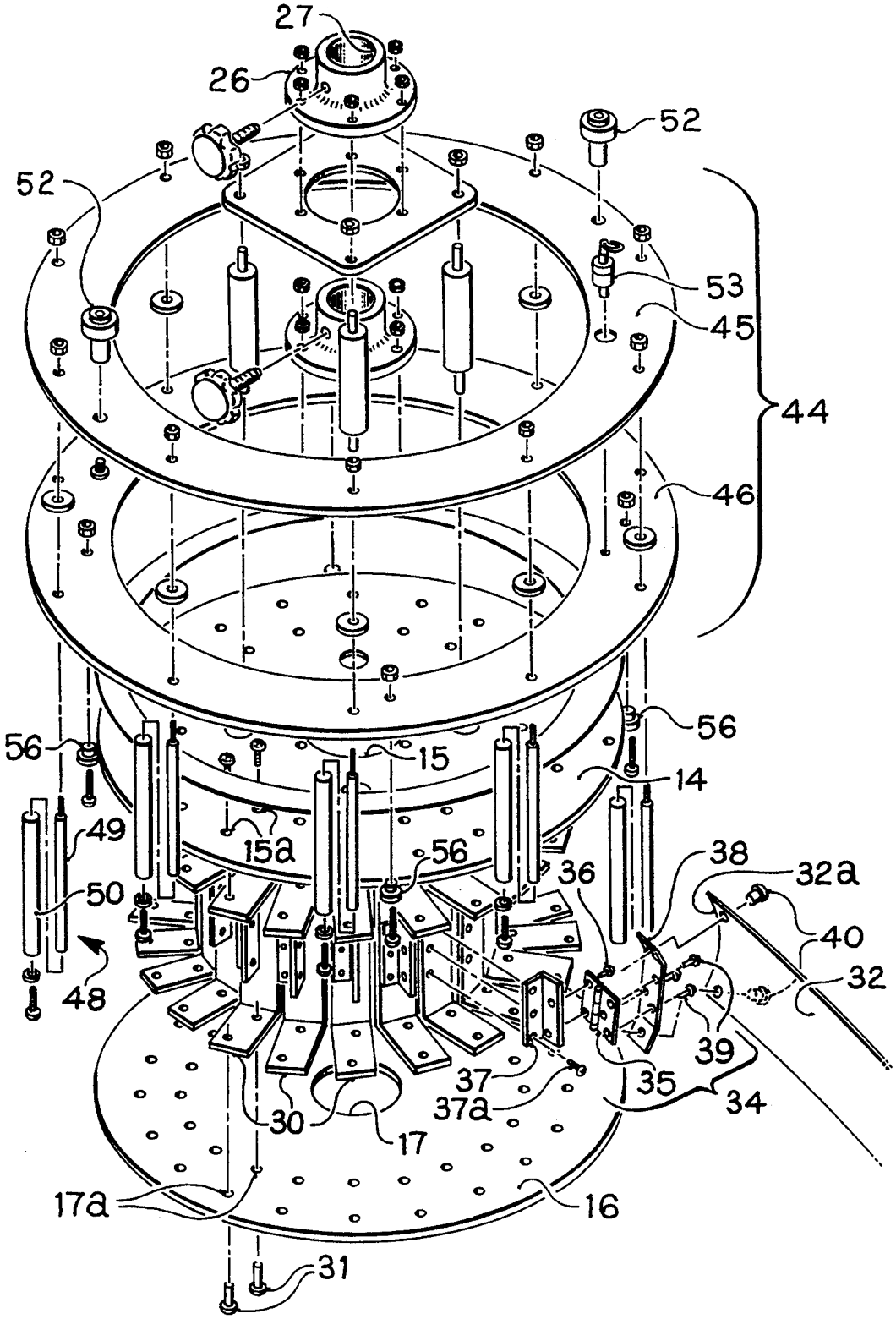
FIG. 4 is an exploded perspective view of the central hub assembly region shown in FIG. 2.

Referring to FIGS. 2–4, the detail of the central hub region will now be described. In its simplest embodiment, the hub assembly 12 is generally spool shaped and comprises a pair of spaced apart generally circular plate members including a bottom plate member 14 and a top plate member 16, both preferably formed from aluminum or light-metal stock having suitable thickness to meet stiffness requirements. The bottom and top plate members 14 and 16 are each provided with a central axial bore hole 15 and 17, respectively, sized for removably mounting a support (not shown) for an antenna feed. A collar 26 is secured to the underside of bottom plate member 14 with its center through bore 27 axially aligned with the bore hole 15 and includes a threaded lock knob 28 for fixing an antenna feed support tube (not shown) within the hub assembly 12 (i.e., within holes 15 and 17 of bottom and top plate members 14 and 16, respectively, and within through bore 27 of collar 26).

In the preferred embodiment, the bottom and top plate members 14 and 16 are held in a spaced relationship by a plurality of channel members 30, C-shaped in cross section, which are evenly spaced about the periphery of the hub assembly 12.

As is evident from the drawings, each channel member 30 serves a dual function, since in addition to forming a side wall portion of the hub assembly, they also serve as the base or anchor portion for each of the modular rib assemblies 22. The individual channel members 30 are preferably fabricated from a single aluminum or light metal extrusion which is sectioned off along its length at regular intervals. The channel members 30 are secured in place by rivet fasteners 31 directed through coaligned holes 15*a* and 17*a* provided to the periphery of each of the bottom and top plate members 14 and 16, respectively.

An advantageous feature of the present invention is that the overall design of the reflector itself does not change for different reflector sizes. Only different sized hardware components are required to build a reflector of a larger or smaller diameter, i.e. rib members, channel members, top and bottom plate members, etc.

Figure 5:
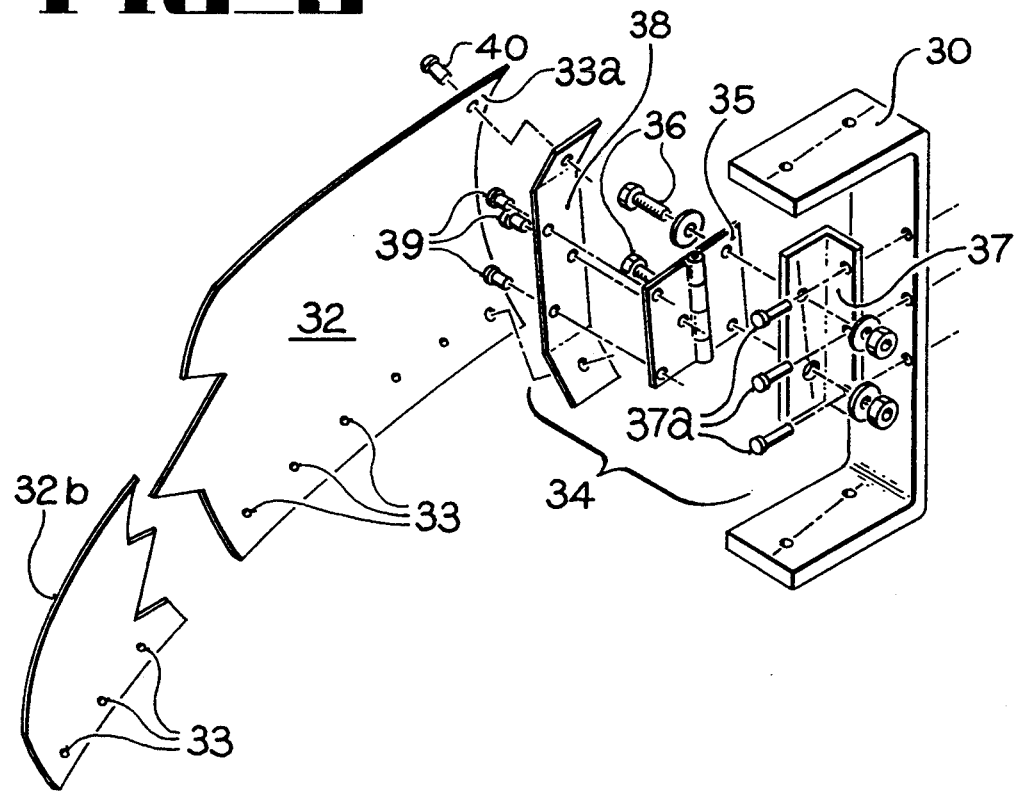
FIG. 5 is an exploded perspective view of a modular rib assembly which is attachable to the hub assembly.

As best seen in FIGS. 4–5, each of the modular rib assemblies 22 further include (in addition to the above mention channel member 30) a rib member 32 having an inner rib end 32*a* and an outer rib end 32*b* and a hinge assembly 34 for pivotally connecting the inner rib end 32*a* to the channel member 30. Each rib member 32 is upwardly curved along its radial length from inner end 32*a* to outward end 32*b* in conformity with the desired parabolic dish shape of the reflector surface. Also, the rib members 32 are preferably parabolic (i.e. a segment of a circle) in cross section. The radius of this cross section is selected such that the stresses with the rib member are within the allowable limit of the strength of the material. The rib members 32 are preferably formed from commercially available, high strength aluminum sheet stock of constant gauge thickness, such as, for example, 7075 T6 aluminum with a 0.024 inch thickness.

The preferred means or method for attaching the metalized mesh 27 to the rib members 32 is by sewing, using a suitable filament material such as, for example, dacron yarn directed through a plurality of spaced threading holes 33 provided along the length of the rib member 32 as shown in FIGS. 5–6. In another embodiment of the invention, the metalized mesh may be glued directly to the ribs using a suitable adhesive. For this alternate attachment method, it is preferred to provide the mesh with additional flaps of material to provide a suitably large contact region to ensure good adhesion between the mesh and the rib member.

The hinge assembly 34 preferably includes a simple door hinge 35 which may be purchased from a local hardware store. The hinge 35 is pinned along a first side edge by bolt fasteners 36 to an L-bracket or angle 37 which, in turn, is pinned or riveted to the channel member 30 by pins 37*a*. The opposite side edge of the hinge 35 is connected by pins 39 to a fitting 38 which, in turn, is connected by pins 40 to the inner end 32*a* of rib member 32. The fitting 38 is preferably formed as a length of stainless steel sheet stock that has been bent at its opposing ends to conform to the parabolic curvature of the rib member inner end 32*a*.

With reference to FIGS. 3–4, the means for furling and unfurling the rib members 32 about the hub assembly 12 will now be described. The preferred rib furling means comprise an annular ring assembly 44 which is rotatably mounted to the underside of the bottom plate member 14. The means for rotatably mounting the ring assembly 44 to the hub assembly is discussed in more detail below with reference to FIGS. 6A–6B.

The annular ring assembly 44 preferably consists of two flat aluminum ring members 45, 46, sandwiched together and spaced apart by a plurality of spacers 47, and on which a plurality of upstanding rib furling elements 48 in the form of candle-like assemblies are secured. While in an alternate embodiment, a single ring member will suffice and function the same as the dual ring member construction shown and described herein, it is found that the two ring member construction provides superior rigidity for handling the loads experienced at the junctures with the individual rib furling elements 48.

The rib furling elements 48 are preferably removably mounted spaced about the periphery of the annular ring assembly 44 and are disposed projecting upwardly (i.e., in the direction from the bottom plate member 14 to the top plate member 16) between selected adjacent pairs of rib members 32. The preferred number and spacing of the rib furling elements 48 is dependent on the size of the reflector 10 and the number of modular rib assemblies 22 to the included therewith. For best results, the rib furling elements should be interposed between every two or three rib members 32.

In the preferred embodiment, the rib furling elements 48 consist of an inner steel rod 49 fixedly mounted to the ring assembly and an outer and rotatably mounted aluminum sleeve 50. To facilitate rotation of the sleeve 50 about the rod 49, a suitable bearing surface is interposed between the rod 49 and sleeve 50, such as, for example, a thin shrink fit plastic tubing (not shown) provided to the outer surface of the rod 49. Alternatively, the rib furling elements 48 may consist of a simple rod member having a slick outer surface to permit low friction slidable contact with the rib members 32 as they are brought into contact thereagainst upon rotation of the ring assembly during stowage or deployment operations of the reflector 10.

The annular ring assembly 44 is also provided with at least one and preferably two handles 52 disposed mounted along the back side thereof to facilitate manually rotation of the ring assembly 44 in order to furl unfurl the rib members 32 about the hub assembly 12. The annular ring assembly further includes a spring loaded lock ring 53 to lock the rotatably annular ring assembly 44 in place with respect to the hub assembly 12 in both the stowed and deployed positions of the reflector 10. The dimensions for the hub diameter and rib length and number of rib furling elements are selected such that the reflector is fully deployed or fully stowed upon one revolution of the annular ring assembly.

In order to achieve a minimum stack or packing height for the reflector as the rib members 32 are furled about the hub assembly during stowage, the two hole drillings in the angle 37 which receive the bolt fasteners 36 are offset such that the pivot axis of the hinge is obliquely oriented with respect to the central vertical axis of the hub assembly by an angle $\theta$. For best results, i.e., where the upwardly parabolically curved rib members 32 will furl horizontally about the hub assembly 12, the angle $\theta$ is selected as the tangent to the parabola at the location of the hinge axis or by the formula:

$\theta = R/2F$, where

R = radius of the reflector at the hingeline

F = Focal length of the reflector

Figures 6A, 6B:
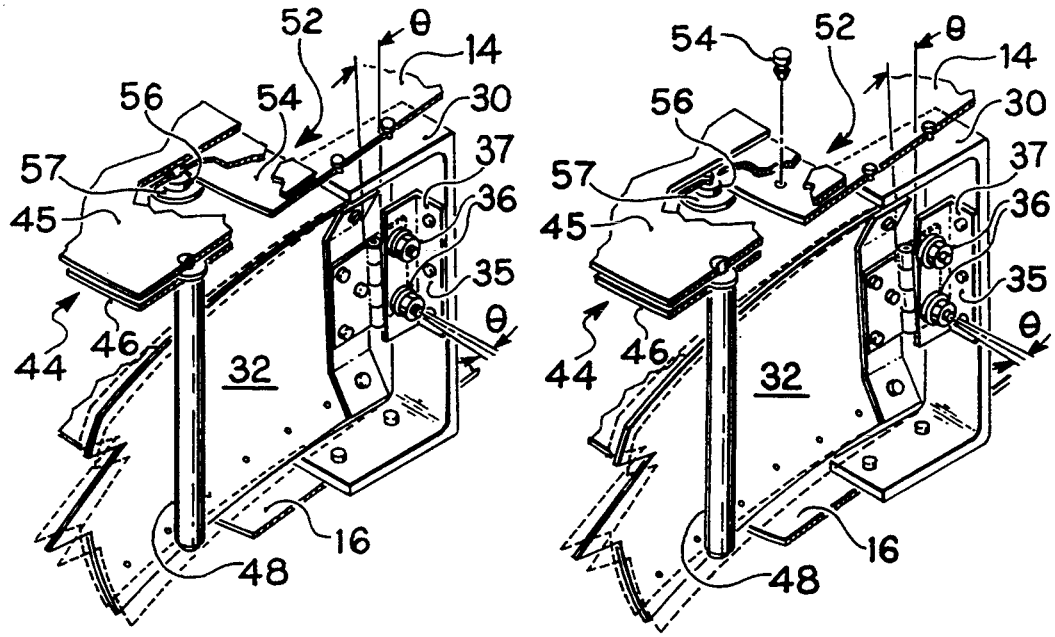
FIG. 6A is a close up perspective view of the modular rib assembly of FIG. 5 shown with the annular ring assembly positioned thereover and also showing a rib furling element disposed contacting the rib member.
FIG. 6B is a close up perspective view similar to FIG. 6A showing an alternate embodiment for the bearing keeper assembly which includes a thin hard plastic ring member.

FIGS. 6A–6B illustrate alternate embodiments of a bearing keeper assembly which is used for rotatably mounting the annular ring assembly 44 to the underside of the bottom plate member 14 of the hub assembly 12. The general function of the bearing keeper assembly is to maintain two flat circular plate members in a predetermined rotatably spaced relationship with respect to one another, much like a "lazy-Susan" type carousel device except that the bearing keeper of the present invention advantageously obviates the need for a roller bearing assembly of the prior art carousel devices.

FIG. 6A shows the preferred embodiment of the bearing keeper assembly 52 as comprising a plurality of hard plastic button members 54 evenly spaced along the zone of overlap between the ring member 46 and the bottom plate member 14. The button members 54 have a barbed end which is fixedly inserted within a receiving hole of the ring member and a flat end which, in use, bears against the bottom surface of the bottom plate member 14. The hard plastic button members 54 are also commercially available from any hardware store. The bearing keeper assembly 52 further includes a plurality of upstanding button-like retainers 56 disposed evenly spaced along the ring member 46 adjacent the perimeter edge boundary of the bottom plate member 14. Each retainer 56 has a shoulder portion which overlaps and engagingly retains the perimeter edge of the bottom plate member 14. The retainers 56 are preferably formed from a hard plastic such as nylon.

FIG. 6B shows an alternate embodiment for the bearing keeper assembly 52' which is similar to the bearing keeper assembly 52 of FIG. 6A except that a Teflon® ring or other plastic bearing 54' (interposed between the ring member 46 and the bottom plate member 14) has been substituted in place of the plastic button members 54. For best results, the Teflon ring bearing 54' should be fixed in place by adhesion to either the ring member 46 or the bottom plate member 14 to prevent galling or binding.

Figure 7:
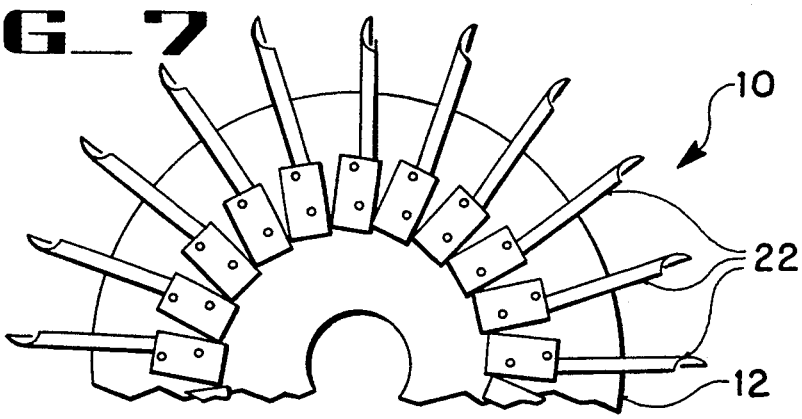
FIGS. 7–9 are a series of diagrammatic views which illustrate how the attachable/detachable modular rib assemblies can be varied in number according to the size and performance requirement for a particular reflector application.
Figure 8:
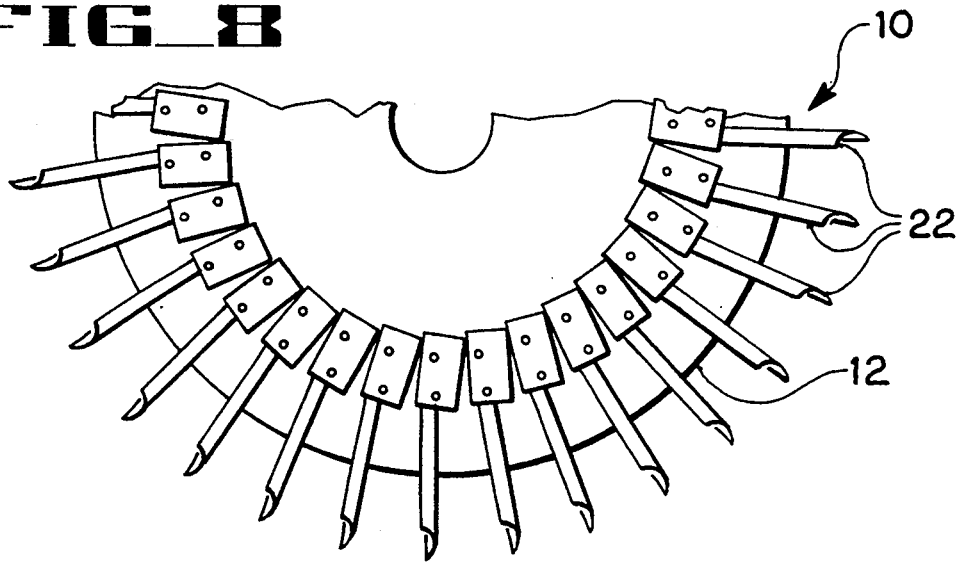
Figure 9:
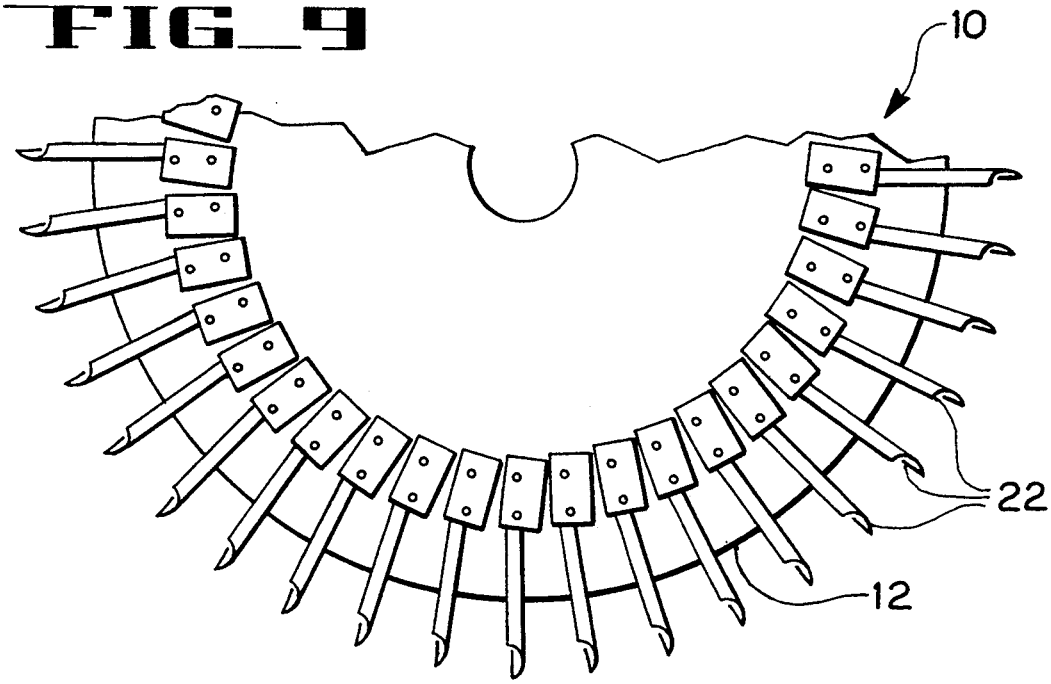

FIGS. 7–9 is a series of schematic views of three different sized reflectors 10 showing how the number of attachable modular rib assemblies 22 may be increased to accommodate larger diameter reflectors. As noted previously and as indicated in phantom in FIG. 8, for any given reflector diameter, the number of evenly spaced modular rib assemblies 22 attached to the hub assembly 12 may be varied to achieve a desired level of accuracy for the parabolic curvature of the reflector surface for a particular application.

Figure 10:
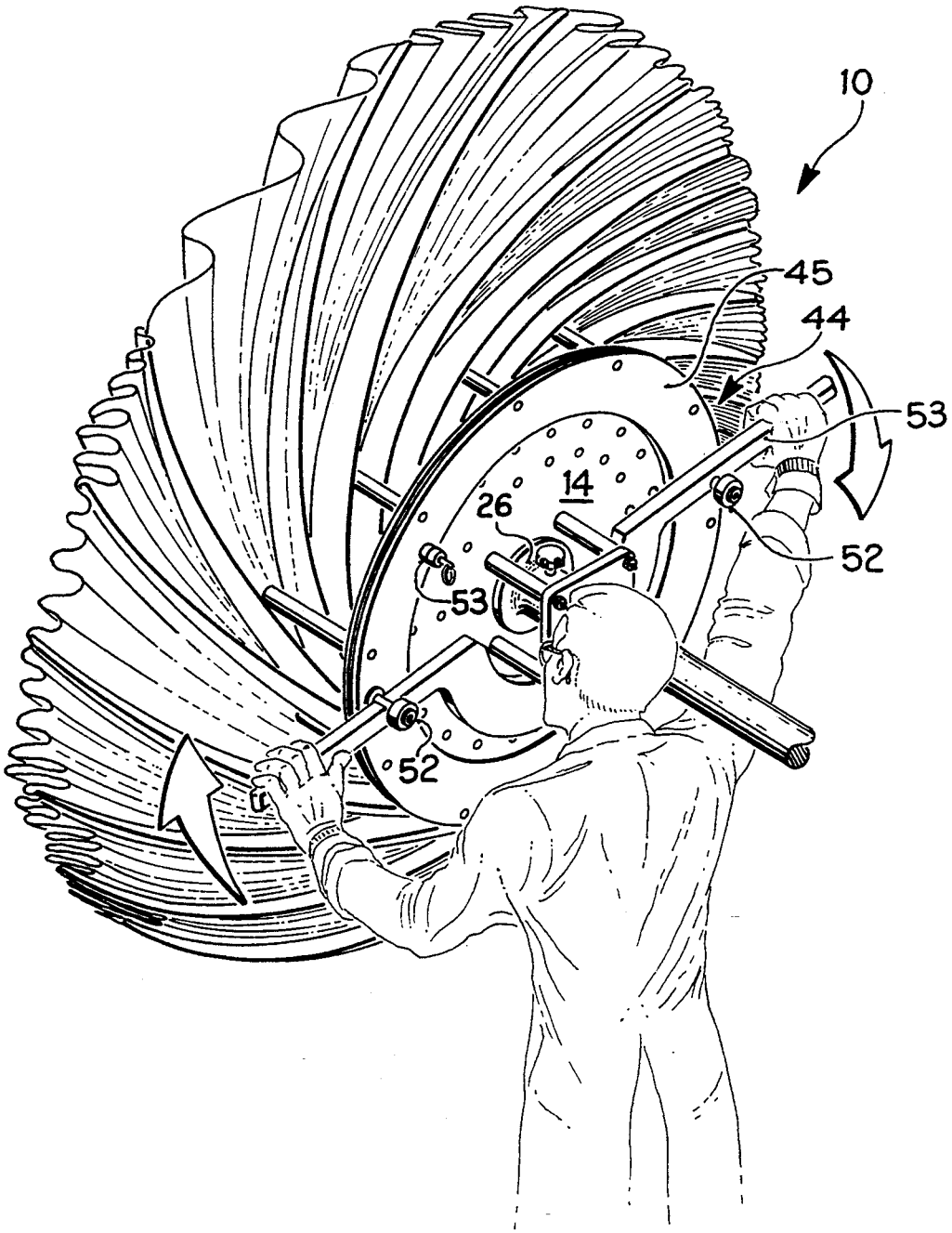
FIG. 10 is a perspective view which illustrates how the reflector of the present invention can be manually stowed and/or deployed by a single person.

FIG. 10 shows a simple tool 52 which provides additional leverage to the handles 52 for manual stowage of larger reflectors 10. During deployment of the reflector 10, such a tool is often not needed due to the spring force stored in the rib members when wound about the hub assembly 12. This spring force urges the rib members to straighten to their radially extended positions during deployment.

Figure 11:
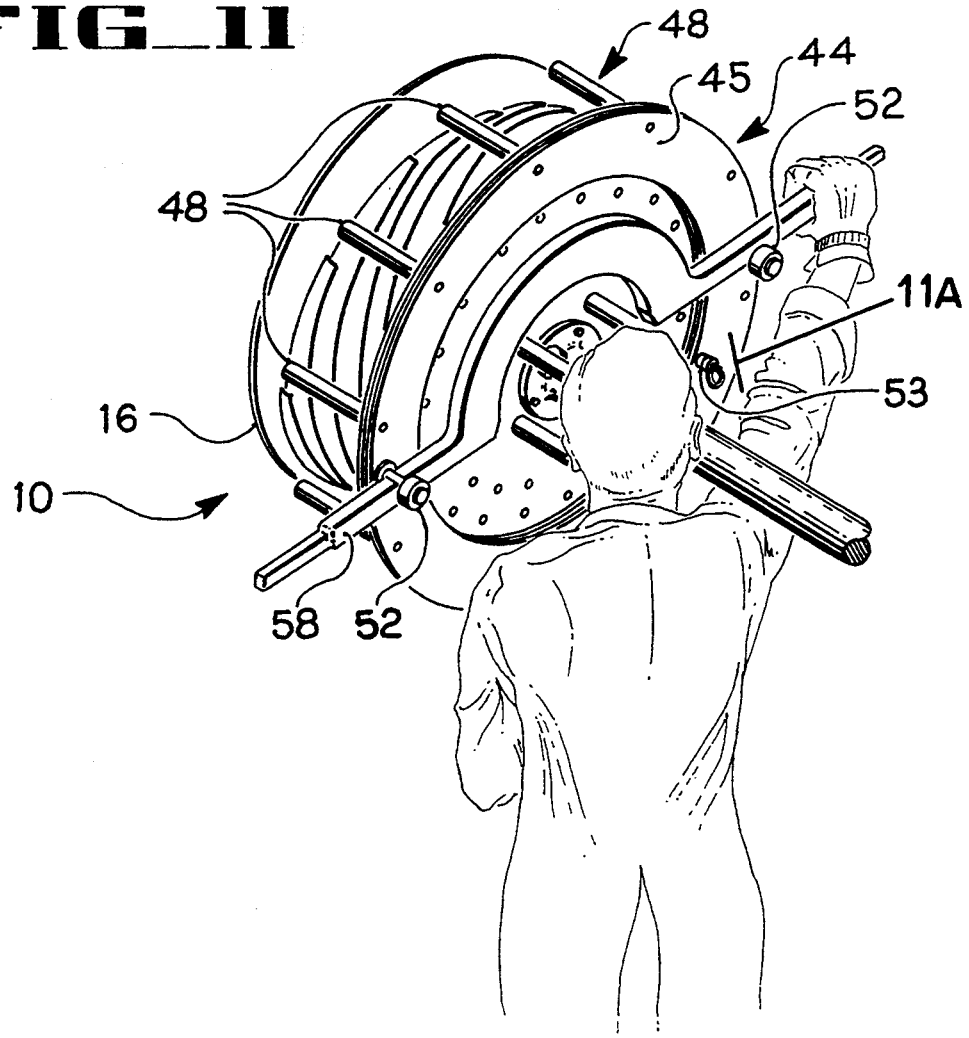
FIG. 11 is a perspective view similar to FIG. 10 showing the reflector in the stowed position.
Figure 11A:
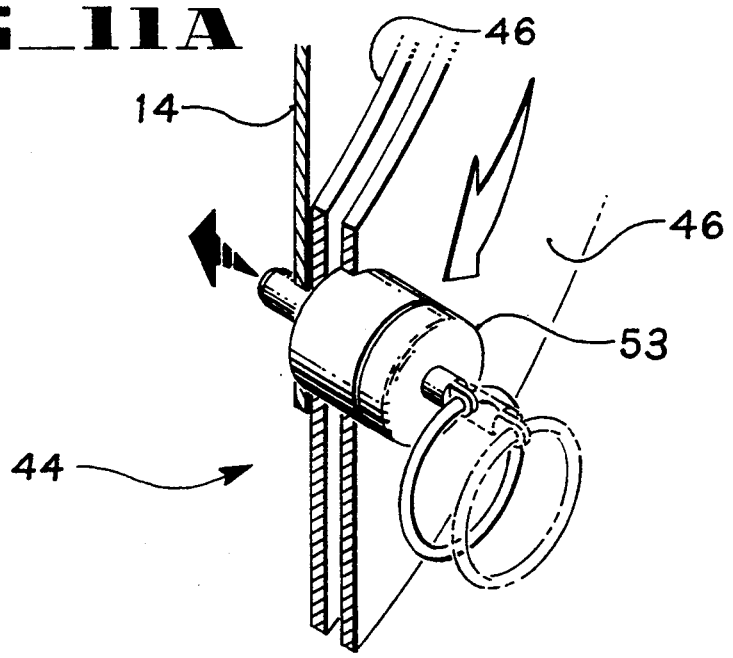
FIG. 11A is an enlarged fragmentary perspective view of the region 11A of FIG. 10 showing the detail of a spring loaded locking pin device for locking the rotatable annular ring assembly to the bottom plate of the hub assembly.

FIG. 11 shows the reflector 10 in the fully stowed position. FIG. 11A is an enlarged view of the region 11A of FIG. 11 showing the two positions for the spring loaded lock ring 53 for locking the ring members 45 and 46 of the rotatable annular ring assembly 44 to the bottom plate member 14 of the hub assembly 12.

Figure 12:
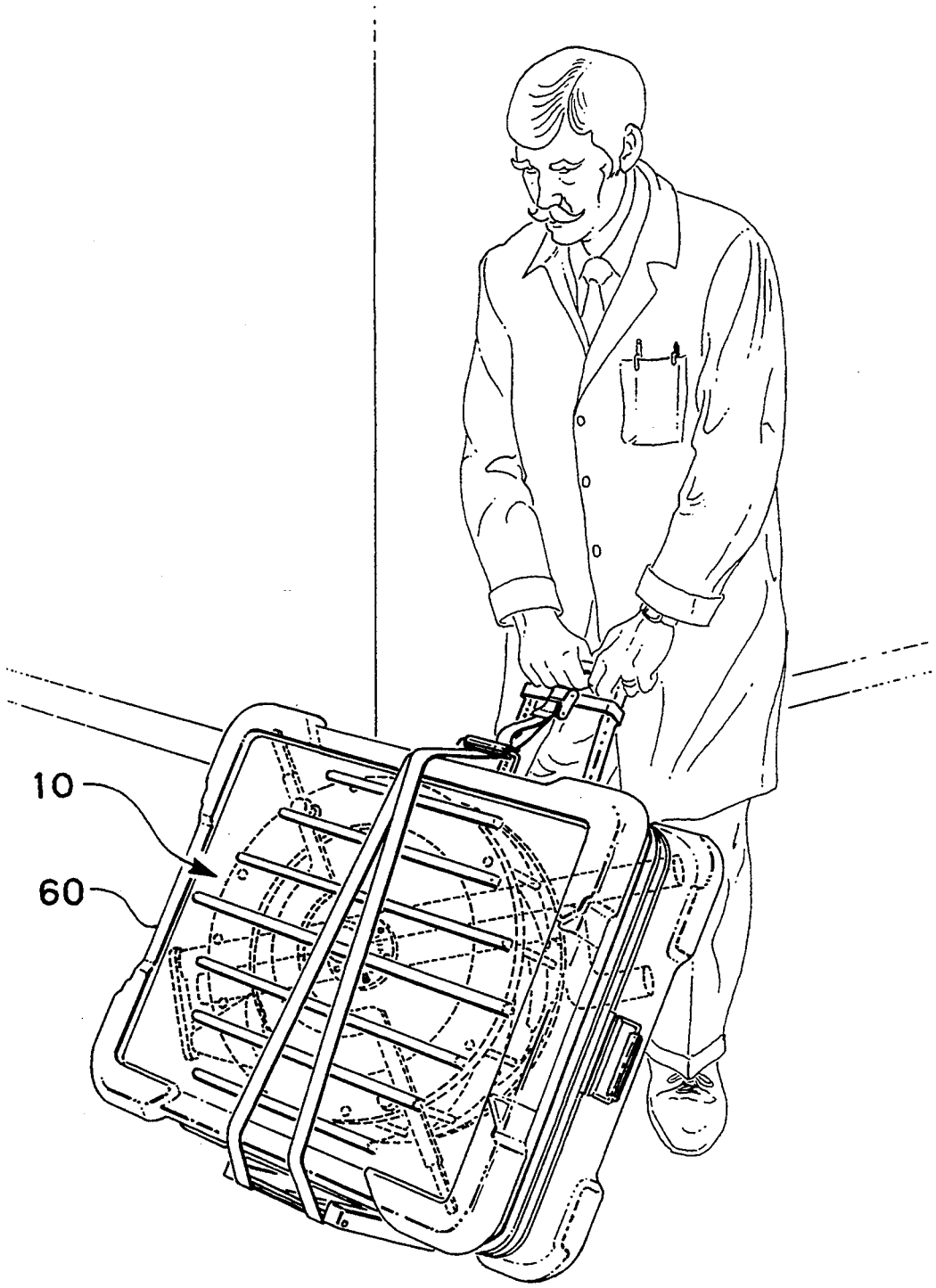
FIG. 12 is a perspective view showing a container for a fully stowed reflector for portable or mobile applications.

FIG. 12 illustrates the portability feature of the redeployable furlable rib reflector 10 of the invention and shows a container 60 for housing the reflector 10 once the rib members 32 have been furled about the hub assembly 12 and the spring loaded lock ring 53 is locked in place.

It should be understood that various modifications within the scope of this invention can be made by one of ordinary skill in the art without departing from the spirit thereof. We therefore wish our invention to be defined by the scope of the appended claims as broadly as the prior art will permit, and in view of the specification if need be.

PARTS LIST

| | |
|---|---|
| 10. Redeployable Furlable Rib Reflector | 46. Ring Member |
| 12. Hub Assembly | 48. Rib Furling Elements |
| 14. Bottom Plate Member | 49. Steel Rod |
| 15. Hole | 50. Aluminum Sleeve |
| 16. Top Plate Member | 52. Bearing Keeper Assembly |
| 17. Hole | 53. Spring Loaded Lock Ring |
| 18. Antenna Feed Assembly | 54. Bottom Member |
| | 56. Retainers |

-continued

PARTS LIST

| | |
|---|---|
| 20. Standoff Assembly | 57. Shoulder |
| 22. Modular Rib Assembly | 58. Tool |
| 24. Metalized Mesh | 60. Container |
| 26. Collar | |
| 27. Through Bore | |
| 28. Threaded Lock Knob | |
| 30. C-shaped Channel Member | |
| 31. Rivet Fasteners | |
| 32. Rib Member | |
| 33. Hole | |
| 34. Hinge Assembly | |
| 35. Hinge | |
| 36. Bolt Fasteners | |
| 37. Angle | |
| 37(a). Pin | |
| 38. Fitting | |
| 39. Pin | |
| 40. Pin | |
| 44. Annular Ring Assembly | |
| 45. Ring Member | |

What is claimed:

1. A redeployable furlable rib reflector which is furlable and unfurlable between a first stowed position and a second deployed position comprising:

a) a generally spool-shaped hub assembly including a top plate member and a bottom plate member spaced from said top plate member, said top and bottom plate members having a central axial bore sized for removably mounting a support for an antenna feed horn;

b) a plurality of modular rib means spaced about said hub assembly, each of said modular rib means including:

i) a channel section base member attachable between said top and bottom plate members;

ii) a rib member having an inward end and an outward end and constructed to permit the rib member to be circumferentially furled about said hub assembly;

iii) hinge means for pivotally attaching said inward end of said rib member to said channel section base member and for facilitating the furling of said rib member;

c) a preformed lightweight flexible metalized mesh stretched across and attached to said plurality of modular rib means for forming a dish-shaped reflective surface when said reflector is deployed;

d) manually actuable rib furling means rotatably attached to said hub assembly for furling and unfurling the reflector between a first stowed position and a second deployed position, and wherein said manually actuable rib furling means comprises:

i) an annular ring assembly disposed overlying said bottom plate member of said hub assembly;

ii) bearing keeper means for rotatably attaching said annular ring assembly to said bottom plate member; and iii) said annular ring assembly includes a plurality of rib furling elements disposed extending therefrom and interposed between selected adjacent pairs of modular rib means and handle means actuable by a user for rotating said annular ring assembly and causing said rib furling elements to furl and unfurl said modular rib means about said hub assembly.

2. A redeployable furlable rib reflector as in claim 1 wherein said channel section of each of said modular rib means form a peripheral wall portion of said hub assembly.

3. A redeployable furlable rib reflector as in claim 2 wherein:

a) said rib member of each of said modular rib means is curved generally upward from said inward end to said outward end; and b) said hinge means of each of said modular rib means has a hinge axis oriented at an oblique angle with respect to a vertical axis of an adjacent channel section base member to provide a reduction in packing height of the reflector when furled into the stowed position.

4. A redeployable furlable rib reflector as in claim 3 wherein said hinge means comprises a door hinge.

5. A redeployable furlable rib reflector as in claim 1 wherein said bearing keeper means for rotatably attaching said annular ring assembly to said bottom plate member includes:

a) a plurality of plastic buttons spaced in a zone of overlap between said ring assembly and said bottom plate of said hub assembly, said plastic buttons having a first end secured to said annular ring assembly and a second end defining a bearing surface with said bottom plate member; and b) a plurality of spaced retainer members extending from said annular ring assembly for engaging and retaining a peripheral edge of said bottom plate member.

6. A redeployable furlable rib reflector as in claim 1 wherein said bearing keeper means for rotatably attaching said annular ring assembly to said bottom plate member includes:

a) a plastic ring bearing disposed in a zone of overlap between said annular ring assembly and said bottom plate member; and b) a plurality of spaced retainer members extending from said annular ring assembly for engaging and retaining a peripheral edge of said bottom plate member.

7. A redeployable furlable rib reflector as in claim 1 wherein said rib furling elements include:

a) an inner rod member secured at one end to said bottom plate member: and b) an outer sleeve member disposed rotatably mounted to said inner rod member.

8. A redeployable furlable rib reflector as in claim 5 wherein said rib furling elements include:

a) an inner rod member secured at one end to said bottom plate member: and b) an outer sleeve member disposed rotatably mounted to said inner rod member.

9. A redeployable furlable rib reflector as in claim 6 wherein said rib furling elements include:

a) an inner rod member secured at one end to said bottom plate member: and b) an outer sleeve member disposed rotatably mounted to said inner rod member.

10. A redeployable furlable rib reflector as in claim 1 wherein:

a) said rib members have a plurality of spaced stitch holes disposed along a radial length thereof; and b) said means for attaching said metalized mesh to said modular rib means includes sewn stitches connecting individual filaments of said metalized mesh to said stitch holes of said rib members.

11. A modular rib assembly for use in combination with a hub assembly of a redeployable furlable rib reflector which is furlable and unfurlable between a first stowed position and a second deployed position and for supporting a preformed lightweight flexible metalized mesh in a dish-shaped reflective surface configuration when said reflector is deployed, said modular rib assembly comprising:

a) a C-shaped channel section base member for attachment at selected locations about a periphery of a hub assembly, said C-shaped channel section base member having an upper flange member and a lower flange member;

b) a normally parabolically curved rib member having an inward end and an outward end and constructed to permit the rib member to be circumferentially furled about said hub assembly; and c) hinge means for pivotally attaching said inward end of said rib member to said C-shaped channel section base member and for facilitating the circumferential furling of said rib member in a spiral manner about a periphery of the hub assembly with a low stack height such that said rib member fits within the upper and lower flange members of said C-shaped channel section base member as said rib member is moved from a deployed position into a stowed position.

12. A modular rib assembly as in claim 11 wherein said channel section forms a peripheral wall portion of said hub assembly.

13. A modular rib assembly as in claim 12 wherein:

a) said rib member is curved generally upward from said inward end to said outward end; and b) said hinge means has a hinge axis oriented at an oblique angle with respect to a vertical axis of an adjacent channel section base member to provide a reduction in packing height of the reflector when furled into the stowed position.

14. A modular rib assembly as in claim 13 wherein said hinge means comprises a door hinge.

15. A modular rib assembly as in claim 14 wherein said rib member is provided with a plurality of spaced stitch holes disposed along a radial length thereof to facilitate sewn attachment of a reflector surface.

16. A method of deploying a furlable rib reflector comprising the steps of:

a) providing a plurality of ribs radially extended about a central hub for supporting a preformed lightweight flexible metalized mesh stretched thereacross and attached thereto so that a dish-shaped reflective surface is formed when said reflector is deployed;

b) pivotally attaching the ribs to the hub about a periphery thereof, the hub defining a central axis;

c) interposing rib furling elements between selected adjacent pairs of ribs;

d) supporting the rib furling elements on a support structure which can be rotated about said central axis and with respect to said hub; and e) manually rotating the support structure for the rib furling elements to cause the rib furling elements to furl and unfurl the ribs about the periphery of the hub between a first stowed position and a second deployed position.

17. A redeployable furlable rib reflector which is furlable and unfurlable between a first stowed position and a second deployed position comprising:

a) a generally spool-shaped hub assembly including a top plate member and a bottom plate member spaced from said top plate member, said top and bottom plate members having a central axial bore sized for removably mounting a support for an antenna feed horn;

b) a plurality of modular rib assemblies spaced about said hub assembly, each of said modular rib assemblies including:

i) a channel section base member attachable between said top and bottom plate members;

ii) a rib member having an inward end and an outward end and constructed to permit the rib member to be circumferentially furled about said hub assembly;

iii) a hinge assembly for pivotally attaching said inward end of said rib member to said channel section base member and for facilitating the furling of said rib member;

c) a preformed lightweight flexible metalized mesh disposed stretched across and secured to said plurality of modular rib assemblies and defining a dish-shaped reflective surface when said reflector is deployed;

d) manually actuable rib furling assembly rotatably attached to said hub assembly for furling and unfurling the reflector between a first stowed position and a second deployed position, and wherein said manually actuable rib furling assembly comprises:

i) an annular ring assembly disposed overlying said bottom plate member of said hub assembly;

ii) a bearing keeper assembly for rotatably attaching said annular ring assembly to said bottom plate member; and iii) said annular ring assembly includes a plurality of rib furling elements disposed extending therefrom and interposed between selected adjacent pairs of modular rib assemblies and a user actuable handle for rotating said annular ring assembly and causing said rib furling elements to furl and unfurl said rib members about said hub assembly.

18. A redeployable furlable rib reflector as in claim 17 wherein:

a) each of said rib members is curved generally upward from said inward end to said outward end; and b) said hinge assembly of each of said modular rib assemblies has a hinge axis oriented at an oblique angle with respect to a vertical axis of an adjacent channel section base member to provide a reduction in packing height of the reflector when furled into the stowed position.

19. A redeployable furlable rib reflector as in claim 17 wherein said rib furling elements include:

a) an inner rod member secured at one end to said bottom plate member: and b) an outer sleeve member disposed rotatably mounted to said inner rod member.

* * * * *